US006382151B2

(12) United States Patent
Pierik

(10) Patent No.: US 6,382,151 B2
(45) Date of Patent: May 7, 2002

(54) RING GEAR VARIABLE VALVE TRAIN DEVICE

(75) Inventor: Ronald J. Pierik, Rochester, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/791,313

(22) Filed: Feb. 22, 2001

Related U.S. Application Data

(60) Provisional application No. 60/184,619, filed on Feb. 24, 2000.

(51) Int. Cl.[7] ..... F01L 13/00

(52) U.S. Cl. ..... 123/90.16; 123/90.17; 123/90.6

(58) Field of Search ..... 123/90.15, 90.16, 123/90.17, 90.22, 90.31, 90.6

(56) References Cited

U.S. PATENT DOCUMENTS 5,365,895 A * 11/1994 Riley ..... 123/90.16
5,937,809 A * 8/1999 Pierik et al. ..... 123/90.16
6,019,076 A * 2/2000 Pierik et al. ..... 123/90.16
6,041,746 A * 3/2000 Takemura et al. ..... 123/90.16

* cited by examiner

*Primary Examiner*—Weilun Lo
(74) *Attorney, Agent, or Firm*—John VanOphem

(57) ABSTRACT

A ring gear variable valve train device is provided for installation on an internal combustion engine having a rotary input crankshaft provided with a cylindrical eccentric journal having a center offset from the rotational axis of the shaft. A connecting rod disposed on the journal is reciprocated by rotary motion of the input shaft. A frame disposed on the input shaft may be controllably varied to vary the lift and timing of the valve. A rocker arm pivotably disposed on the frame is attached to the connecting rod to oscillate a ring gear portion of the rocker arm in response to rotary motion of the input shaft, which ring gear drives a planetary-geared output cam to actuate an engine intake valve to open and close. The teeth of the ring gear and the planetary gear are axially tapered, and a coil spring disposed on the output shaft is operative axially to displace the planetary gear axially of the ring gear to eliminate gear lash therebetween. In a preferred embodiment, some elements are doubled to control the motion of two parallel valves. Preferably, each cylinder in an internal combustion engine is provided with an apparatus in accordance with the present invention.

11 Claims, 8 Drawing Sheets

RING GEAR VARIABLE VALVE TRAIN DEVICE

CROSS-REFERENCE TO RELATED APPLICATIONS

This application claims the benefit of U.S. Provisional Application 60/184,619 filed Feb. 24, 2000.

TECHNICAL FIELD

The present invention is related to variable valve train systems for use on internal combustion engines; more particularly, to devices for controllably varying the lift of valves in such engines; and most particularly, to a variable valve train device driven by an input crankshaft and employing a ring and planetary gear arrangement that controllably varies the lift of the intake valves to control engine load.

BACKGROUND OF THE INVENTION

Internal combustion engine performance has progressed considerably in the past century. Inventions have yielded cleaner exhaust and enhanced durability, fuel efficiency, and power. Systems for varying the lift and timing of intake valves can further refine and enhance the performance of the internal combustion engine by controllably varying the volume of fuel mix supplied to the combustion chambers as a function of engine load and rotational speed. Fuel economy at part load operation can be increased by promoting more thorough combustion, reducing pumping work done by the pistons, which saps energy, deactivating cylinders, and/or by implementing a lean air/fuel ratio scheme. Matching the intake valve closing time more closely to the engine's need can enhance driveability of a vehicle by improving engine breathing at full engine load. Moreover, if intake and exhaust events can be controlled sufficiently to vary engine load, speed, and fuel dilution over the entire spectrum of required engine operating conditions, a controllable variable valve train can obviate the need for a throttle valve and EGR valve in a gas or diesel internal combustion engine.

A range of variable valve train devices and valve timing mechanisms for enhancing engine performance are known in the automotive art, but commercial use of such devices generally has been impractical because of cost, size, and/or operating limitations which have limited their true value and practicality. For example, variable valve timing (VVT) mechanisms, as disclosed in U.S. Pat. No. 5,937,809 issued Aug. 17, 1999 to Pierik et al. and U.S. Pat. No. 6,019,076 issued Feb. 1, 2000 to Pierik et al., the relevant disclosures of both patents being incorporated herein by reference, employ a segmented single shaft crank rocker (SSCR) for operating individual or multiple engine valves by engaging a linkage with a rotary eccentric, preferably a rotary cam, to drive an oscillatable rocker cam. The disclosed SSCR mechanism has four moving components (two arms, a rocker, and a cam) and thus can be expensive to manufacture and subject to wear and premature failure at a plurality of joints. In addition, in typical prior art VVTs, springs are required to maintain contact between an input cam and a roller follower, which springs tend to increase friction and limit maximum operating speed.

It is a principal object of the present invention to provide total authority over intake valve lift, open valve duration, and phasing of intake and exhaust events relative to the motion of an engine's pistons.

It is a further object of the invention to improve peak engine torque and fuel economy.

It is a still further object of the invention to controllably vary the engine load directly at the engine cylinder, thereby potentially eliminating the need for prior art throttle body and idle air control devices.

It is a still further object of the invention to reduce the size and number of components of the device in comparison with prior art variable valve train devices.

It is a still further object of the invention to provide a variable valve train device which can be economically mass-produced for commercial use in vehicles powered by internal combustion engines.

SUMMARY OF THE INVENTION

Briefly described, a ring gear variable valve train device in accordance with the invention is provided for installation on an internal combustion engine having a rotary input shaft positioned substantially as is a camshaft in a conventional engine. The basic mode of operation is similar to that disclosed in the patents incorporated by reference, wherein a variable valve train apparatus is mounted on an input shaft of an engine, such as a camshaft, and is pivotable about the shaft to alter the timing and lift of a valve opening upon an engine's cylinder. In the present invention, the input shaft, rather than being a conventional camshaft and having an eccentric cam lobe, is provided with a cylindrical eccentric journal having a center offset from the rotational axis of the shaft such that a connecting rod may be disposed conventionally on the journal for deriving reciprocating motion from the rotary motion of the input shaft. A close-fitting frame is rotationally disposed on the camshaft such that the input shaft and journal are free to rotate within the frame. The frame is pivotably connected to an auxiliary control shaft such that the angular orientation of the frame with respect to the input shaft may be controllably varied to vary the lift and timing of the valve. A rocker arm is pivotably disposed on the frame and is attached to the connecting rod to oscillate an arcuate ring gear portion of the rocker arm in response to rotary motion of the input shaft. The ring gear portion meshes with and drives a planetary-geared output cam rotatably disposed on the input shaft to actuate the stem of an engine intake valve to open and then to close the valve conventionally against a valve spring. Preferably, the teeth of the ring gear and the planetary gear are axially tapered in opposite directions, such that a coil spring disposed in compression on the output shaft is operative axially against a side face of the planetary gear to displace the planetary gear axially until all lash is eliminated between the two gears. In a preferred embodiment for controlling the motion of two parallel valves at a single engine cylinder, the elements of the frame, ring gear portion, and output cam are doubled symmetrically about the input shaft journal, and a dual rocker arm cooperates with both ring gear portions for simultaneous and identical actuation thereof. Rotation of the frame about the input shaft serves to alter the timing of the valve opening with respect to the associated piston, the height of the valve lift, and the duration of opening. Preferably, each cylinder in an internal combustion engine is provided with an individual device in accordance with the present invention. The disclosed invention is thus capable of controlling engine load and peak engine torque directly at the cylinder head without resort to a conventional throttle and exhaust gas recirculation (EGR) valve. The invention is also useful for variably controlling the valves of other apparatus incorporating pintle-type valves, for example, compressors for air and other gases.

BRIEF DESCRIPTION OF THE DRAWINGS

These and other features and advantages of the invention will be more fully understood and appreciated from the following description of certain exemplary embodiments of the invention taken together with the accompanying drawings, in which.

DESCRIPTION OF THE PREFERRED EMBODIMENTS

The novelty and benefits of a ring gear variable valve train device in accordance with the invention may be better appreciated by first considering an analogous prior art variable valve train device.

Figure 1:
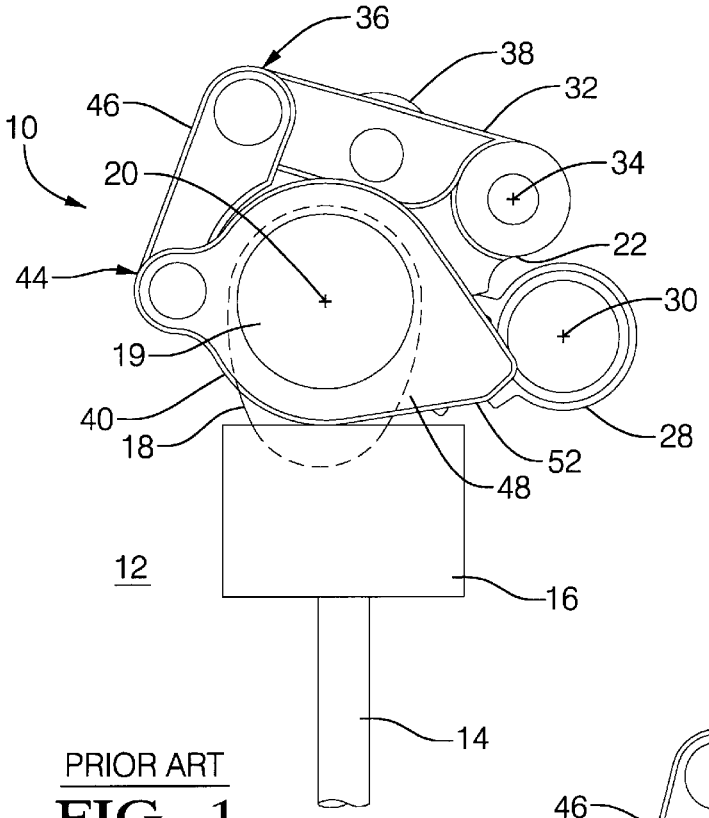
PRIOR ART FIG. 1
FIG. 1 is a semi-schematic end view of a prior art VVT mechanism directly actuating a single engine valve, showing the mechanism in valve-closed position.

Referring to FIG. 1, numeral 10 generally indicates a prior art embodiment of a VVT device which is operable to vary valve timing and lift in an operating engine 12 having a valve 14 actuated through a direct acting follower 16. VVT device 10 includes a rotary input cam lobe 18 carried, for example, on a camshaft 19 and rotatable on a rotational primary axis 20.

Device 10 further includes a control frame 22 including a carrier link or lever 23 which is pivotable about the primary axis 20. Frame 22 is externally drivable by teeth 24 that are engaged by mating teeth 26 formed on a control gear 28 that may be oscillated about an axis 30 parallel to the primary axis. If desired, the control gear 28 could be replaced by a cam or linkage for driving the control frame 22, substantially as is disclosed in, for example, the incorporated reference U.S. Pat. No. 6,019,076. A primary lever or rocker 32 is pivotably connected at one end with frame 22 at a pivot axis 34 spaced from the primary axis 20. Rocker 32 has a distal end 36 and an eccentric follower 38 in the form of a roller or other suitable means for engaging cam lobe 18 and acting as a cam follower.

A secondary lever 40 has one end mounted on and pivotable about the primary axis 20. Secondary lever 40 has a distal end 44 spaced from the axis 20 and operatively connected with the distal end 36 of rocker 32. This operative connection is made by link 46 pivotably interconnecting the two distal ends 44,36. Secondary lever 40 also includes at said one end an oscillating cam 48 having a base circle portion 50 centered on the primary axis 20 and a valve lift portion 52 extending eccentrically outward from the base circle portion. Cam 48 engages the cam follower 16 in a reciprocating motion directly acting upon valve 14 for opening and closing the valve.

Figure 2:
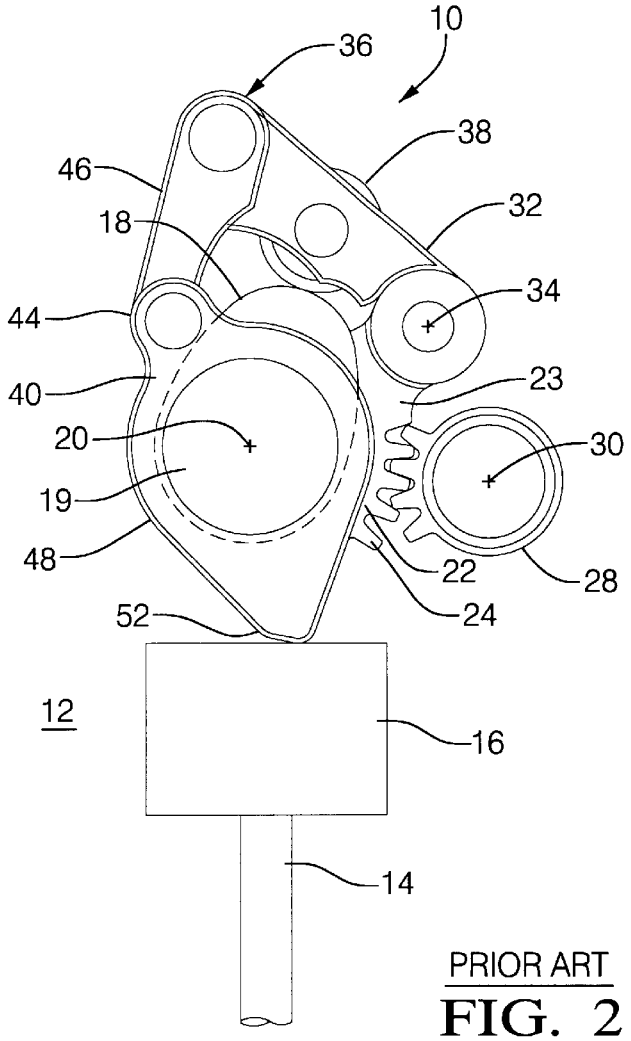
PRIOR ART FIG. 2
FIG. 2 is a view like FIG. 1, showing the mechanism in valve-open position.
Figure 3:
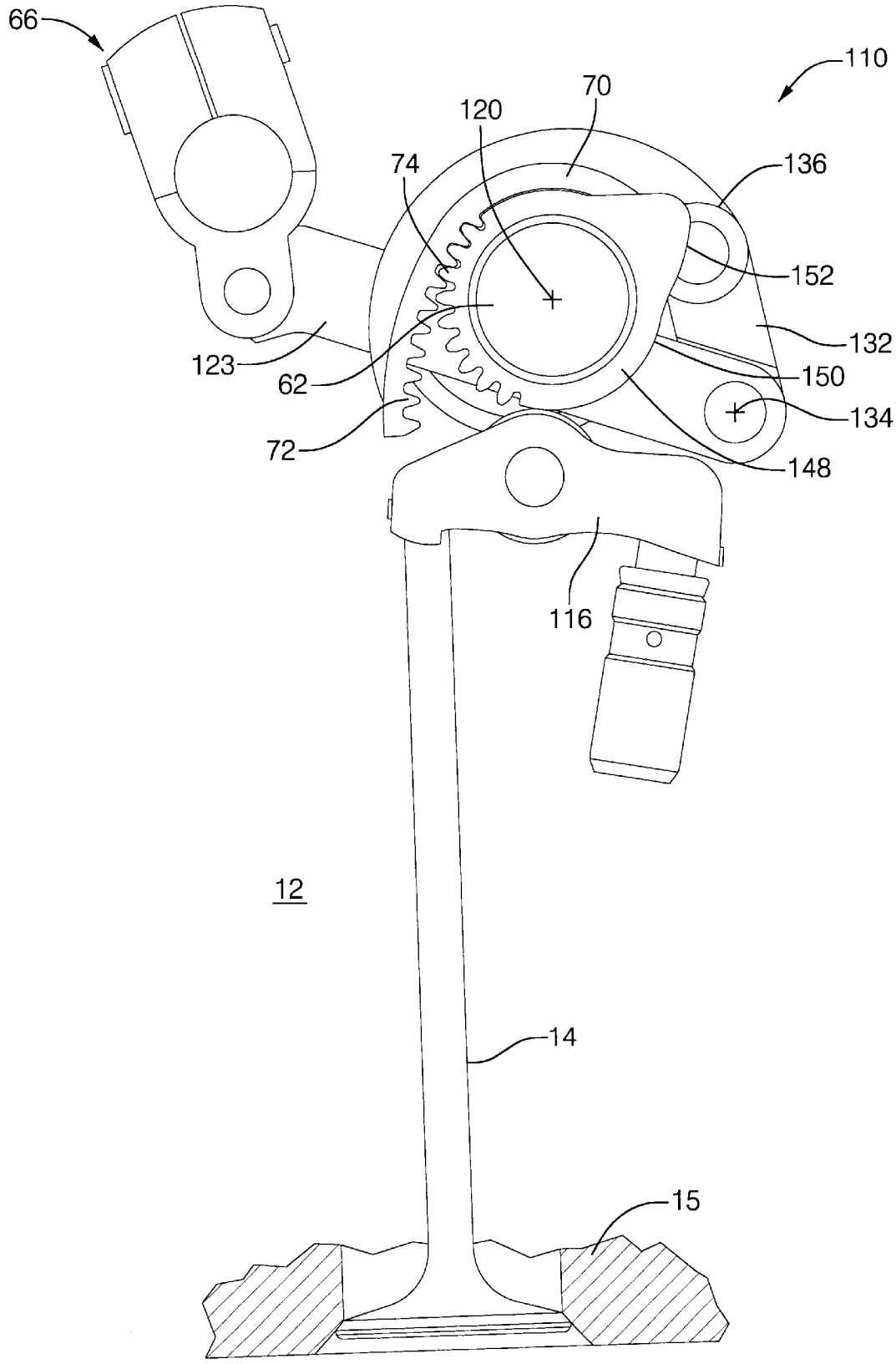
FIG. 3 is a semi-schematic end view of a VVT mechanism in accordance with the invention directly actuating a single engine valve, showing the mechanism in a valve-closed position, comparable to the view of the prior art VVT mechanism shown in FIG. 1.

Referring to FIGS. 1 and 2, in operation, the rotary cam lobe 18 is driven in timed relation with the engine crankshaft by any suitable means, such as a camshaft drive. The control member 22 is positioned in a predetermined orientation which is angularly adjustable to vary valve lift and timing but remains fixed when no change is desired. When the eccentric portion of the cam lobe 18 engages the roller follower 38, the rocker 32 is pivoted outward (up) about the pivot axis 34 located on the control member 22. This raises link 46, causing the secondary lever 40 to rotate clockwise about the primary axis 20 to slide or rock the oscillating cam 48 against the direct acting follower 16.

If the control member 22 is in a first position as shown in FIGS. 1 and 2, the clockwise lever motion causes the valve lift portion 52 of the oscillating cam 48 to actuate the follower 16 downward, opening the valve 14 to its full open position as shown in FIG. 2. Upon further rotation of the rotary cam 18, the roller follower 38 rides back down the cam 18 to its base circle. Secondary lever 40 with oscillating cam 48 pivots counterclockwise, allowing valve 14 to close as the follower 16 is again engaged by the oscillating cam base circle portion 50.

To reduce valve lift and valve open time, the control member 22 is rotated counterclockwise, by rotation of the control gear 28, toward a second position, not shown, of the control member, angularly displaced from the first position. In the second position, the oscillating motion of the cam 48 merely slides its base circle portion 50 against the follower 16 so that the valve remains closed when the device 10 oscillates cam 48. In intermediate positions of the control member 22, the valve will be partially opened for a lesser period of time than with the full opening movement, the proportion of full valve opening depending upon the closeness of the control member to the first (full opening) position.

Referring to FIGS. 3 through 7, a first exemplary embodiment 110 of a ring gear variable valve train device is shown. Elements of device 110 analogous to elements in prior art device 10 are numbered the same but prefaced with a 1; for example, the prior art rocker is 32, and the improved rocker is 132.

Numeral 110 generally indicates an embodiment of a VVT device in accordance with the invention which is operable to vary valve timing and lift in an operating engine 12 having a valve 14 actuated through a roller finger follower 116. VVT device 110 includes an eccentric rotary input crank journal 60 carried, for example, on an input crankshaft 62 and rotatable on a rotational primary axis 120. Journal 60 is conventionally cylindrical and has an axis 64 spaced apart from primary axis 120.

Device 110 further includes a control frame 122 including a carrier link or lever 123 which is pivotable about the primary axis 120. Frame 122 is pivotably disposed on input crankshaft 62 and is rotationally drivable by a control linkage mechanism shown generally as 66, substantially as is fully disclosed in incorporated reference U.S. Pat. No. 6,019,076. Alternatively, frame 122 may be equipped and rotationally driven by mating teeth as described above for prior art device 10.

A primary lever or rocker 132 is pivotably connected at one end with frame 122 at a pivot axis 134 spaced from the primary axis 120. Rocker 132 has a distal end 136 and is pivotably connected at an intermediate location to a connecting rod 68 rotationally disposed on journal 60. It is a specific advantage of a VVT device in accordance with the invention that the rocker, which is common to many VVT device schemes, is positively connected to the eccentric journal through 360° of input shaft rotation and therefore requires no springs, as are required to maintain contact between a cam follower roller and a rotating cam in prior art VVT devices. Distal end 136 includes a portion of a ring gear 70 having teeth 72 extending inwards generally towards secondary axis 134. Ring gear 70 is thus oscillatable with rocker 132 about axis 134. An oscillatable cam 148 is rotatably disposed on input crankshaft 62 radially inward of ring gear portion 70 and has a base circle portion 150 centered on the primary axis 120 and a valve lift portion 152 extending eccentrically outward from the base circle portion. Cam 148 is also a planetary gear and is provided with outwardly-extending gear teeth 74 for engaging the ring gear 70 in a reciprocating motion and therefore directly acting upon follower 16 for opening and closing valve 14.

In operation, the input crankshaft 62 is driven in timed relation with the engine crankshaft by any suitable means, such as a conventional camshaft drive. The control frame 122 is positioned in a predetermined orientation which is angularly adjustable to vary valve lift and timing but remains fixed when no change is desired. As the crank journal 60 of the input crankshaft 60 drives connecting rod 68 outwards, the rocker 132 is pivoted outward (up) about the pivot axis 134 located on the control frame 122. This raises ring gear 70, causing the oscillatable cam 148 to rotate clockwise about the primary axis 120 to slide or rock the oscillating cam 148 against the direct acting follower 16.

Figure 4:
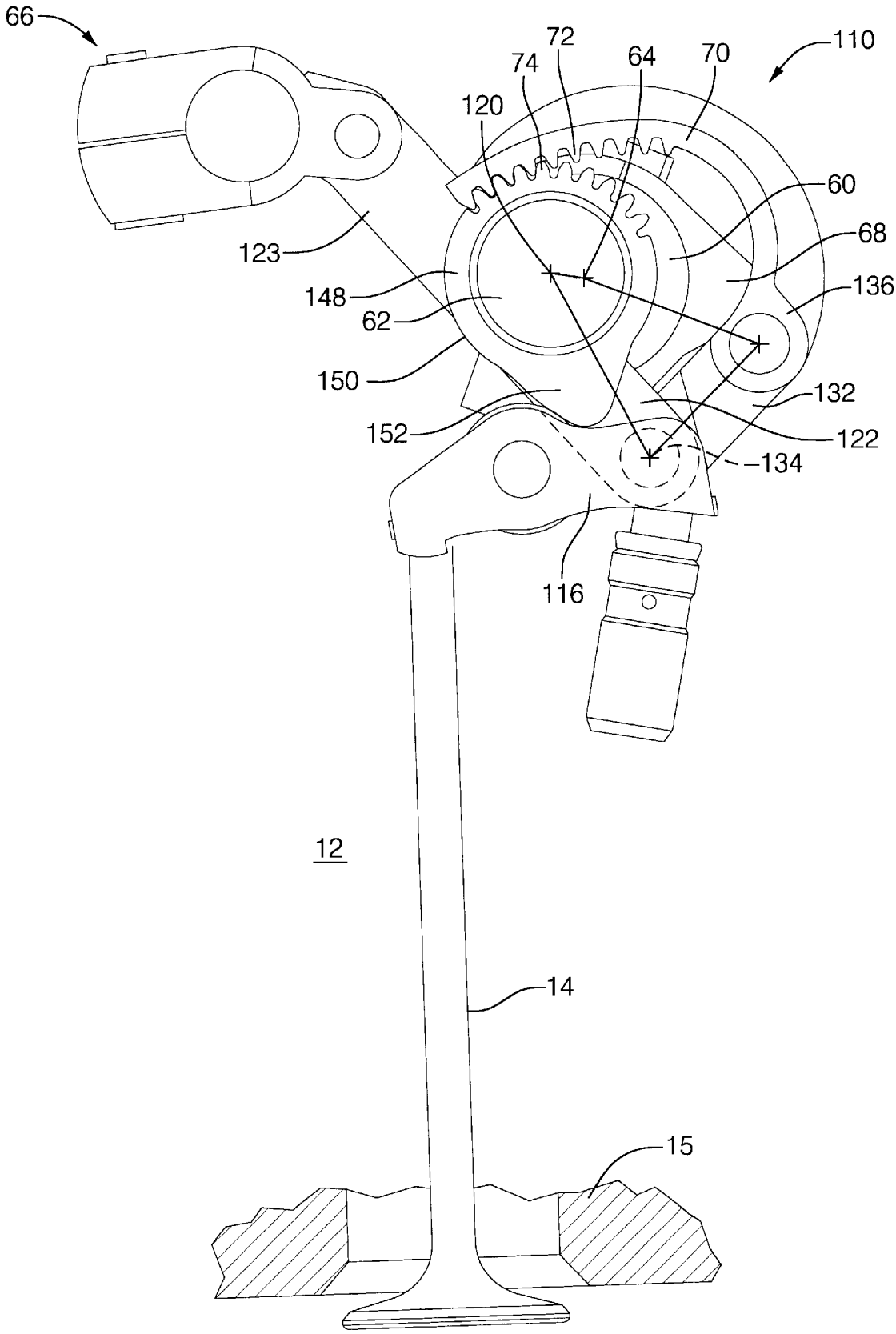
FIG. 4 is a view like FIG. 3, showing the mechanism in valve-open position, comparable to the view of the prior art VVT mechanism shown in FIG. 2.
Figure 5:
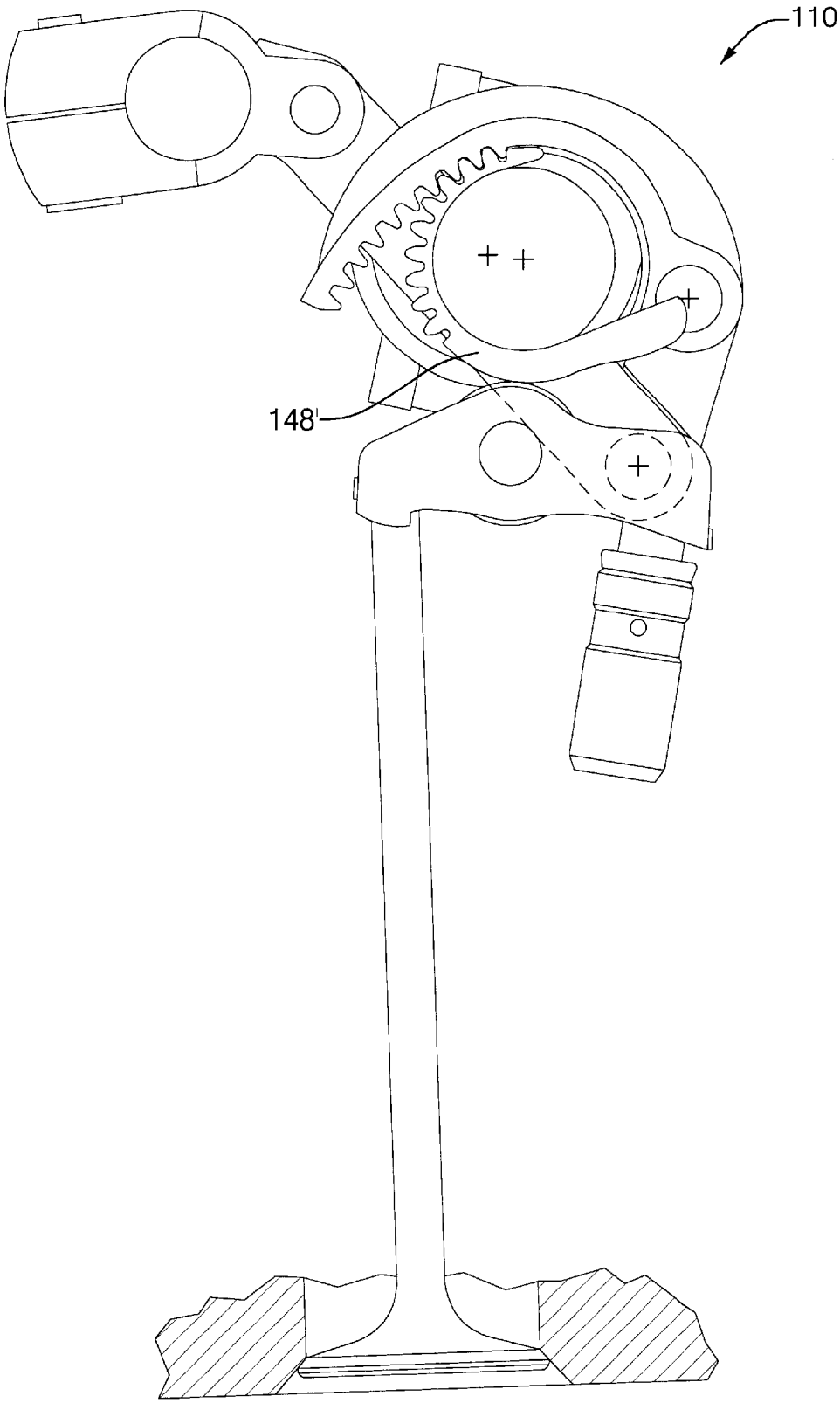
FIG. 5 is a view like that shown in FIG. 3, showing an alternative and preferred embodiment of an oscillable partial cam.
Figure 7:
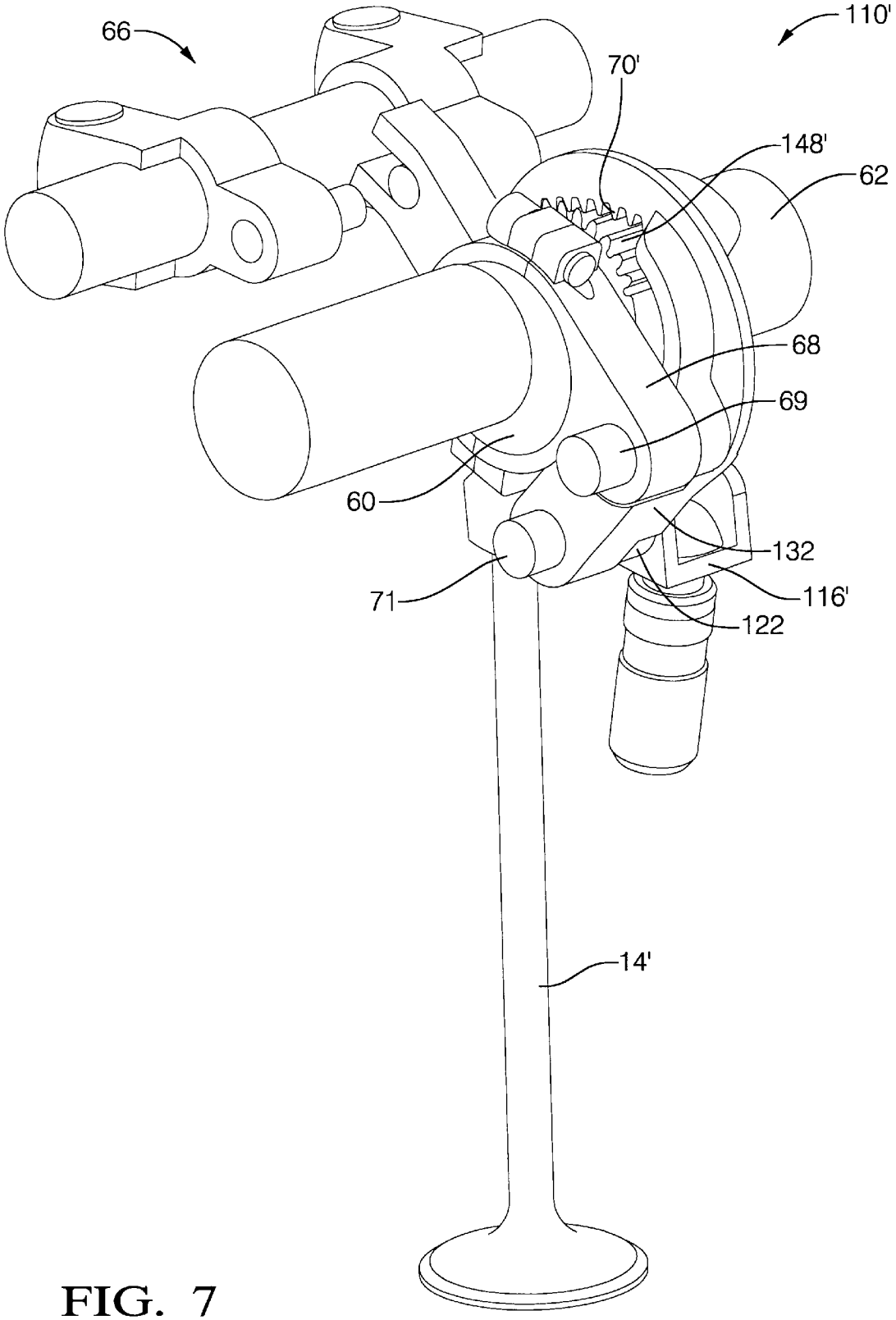
FIG. 7 is an isometric front view of an exemplary embodiment of a variable valve train device in accordance with the present invention, showing the device directly actuating a single engine valve, in the valve-open position, some elements being removed for clarity.

If the control frame 122 is in a first position as shown, for example, in FIGS. 4, 5, and 7, the clockwise cam motion causes the valve lift portion 152 of the oscillating cam 148 to actuate the follower 116 downward, opening the valve 14 from its seat 15 to its full open position as shown in FIG. 4. Upon further rotation of the input crankshaft 62, connecting rod 68 is retracted towards primary axis 120. Rocker 132 and ring gear portion 70 urge oscillating cam 148 to pivot counterclockwise, allowing valve 14 to close against seat 15 as the follower 116 is again engaged by the oscillating cam base circle portion 150.

Figure 6:
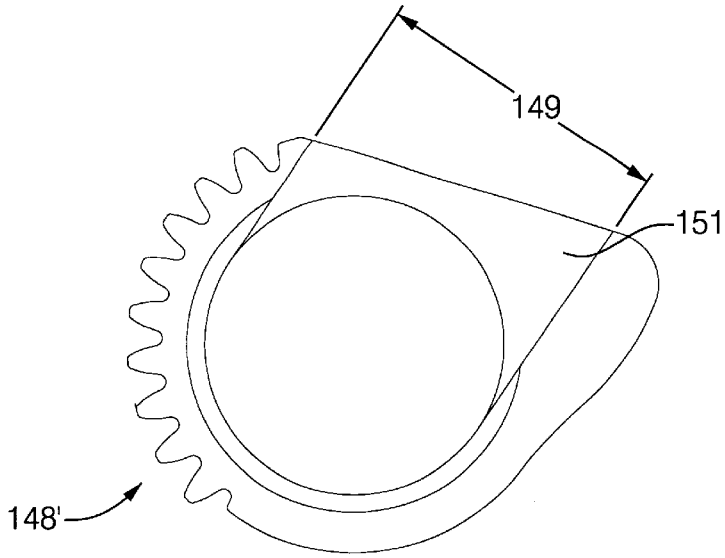
FIG. 6 is a side view of the oscillable partial cam shown in FIG. 5.

Referring to FIGS. 5 and 6, a preferred embodiment 148' of oscillating cam 148 is shown. In a multiple cylinder engine having a plurality of journals 60, a problem arises as to how to install a plurality of cams 148. One solution employed with prior art VVT devices mountable on camshafts has been to segment the camshaft and to key or otherwise assemble the segments together after installation of each VVT device on each segment. This solution is expensive and cumbersome. Improved oscillating cam 148' solves this problem by being formed in an open U shape having a diameter 149 equal to the outside diameter of input crankshaft 62, allowing the cam to be installed on the input shaft from a radial rather than axial direction. Because the cam is captured on the crankshaft by the ring gear, and because all radial forces exerted on the cam during operation are inward over a central bearing angle of no more than 180°, the "missing" portion of cam 148 bears no load and may be omitted, as shown in FIG. 5. If desired, for example, to promote retention of oil on the cam bearing surfaces, a filler block 151, readily formed as by molding of any suitable plastic or metal, may be provided and installed on cam 148' as shown in FIG. 6 after the cam is mounted on the crankshaft. Thus, a plurality of VVT devices 110 in accordance with the invention may be readily installed on a one-piece input shaft having a plurality of crank journals for operating the valves of a multi-cylinder engine.

Figure 6A:
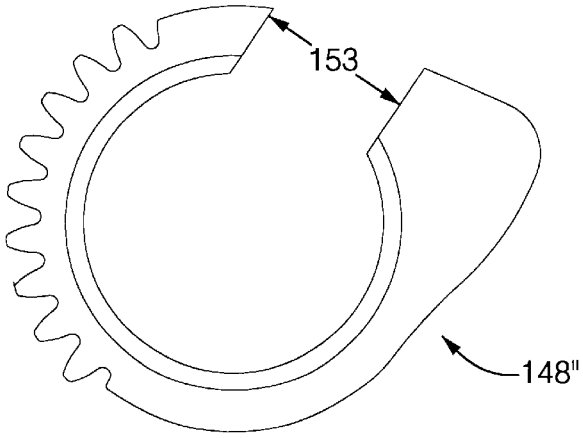
FIG. 6*a* is a side view of a second embodiment of a partial cam.
Figure 6B:
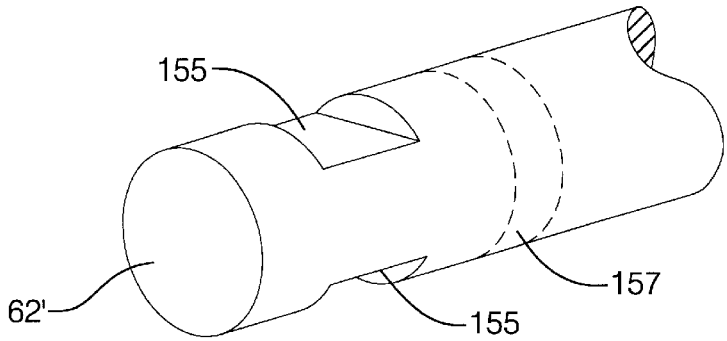
FIG. 6*b* is an isometric view of a second embodiment of a crankshaft for receiving either of the cam embodiments shown in FIGS. 6 and 6*a;*

If the radial forces exerted on a cam extend over a central angle greater than 180°, preventing the elimination of a portion as large as the 180° portion as shown in FIG. 6 and represented by filler block 151, a smaller portion, equivalent to a wide slot 153, still may be eliminated, as shown in cam 148" in FIG. 6*a*. Such a cam also may be radially installed onto a one-piece shaft 62', as shown in FIG. 6*b*, which is provided with a pair of flats 155 outboard of any operational bearing surface, flats 155 being diametrically separated by a distance no greater than the width of slot 153. After the cam is centered on the shaft 62' it may then be slid axially to its final location 157.

To reduce and control valve lift and valve open time, the control frame 122 is rotated counterclockwise, analogous to the actuation described hereinabove for prior art VVT device 10.

Figure 8:
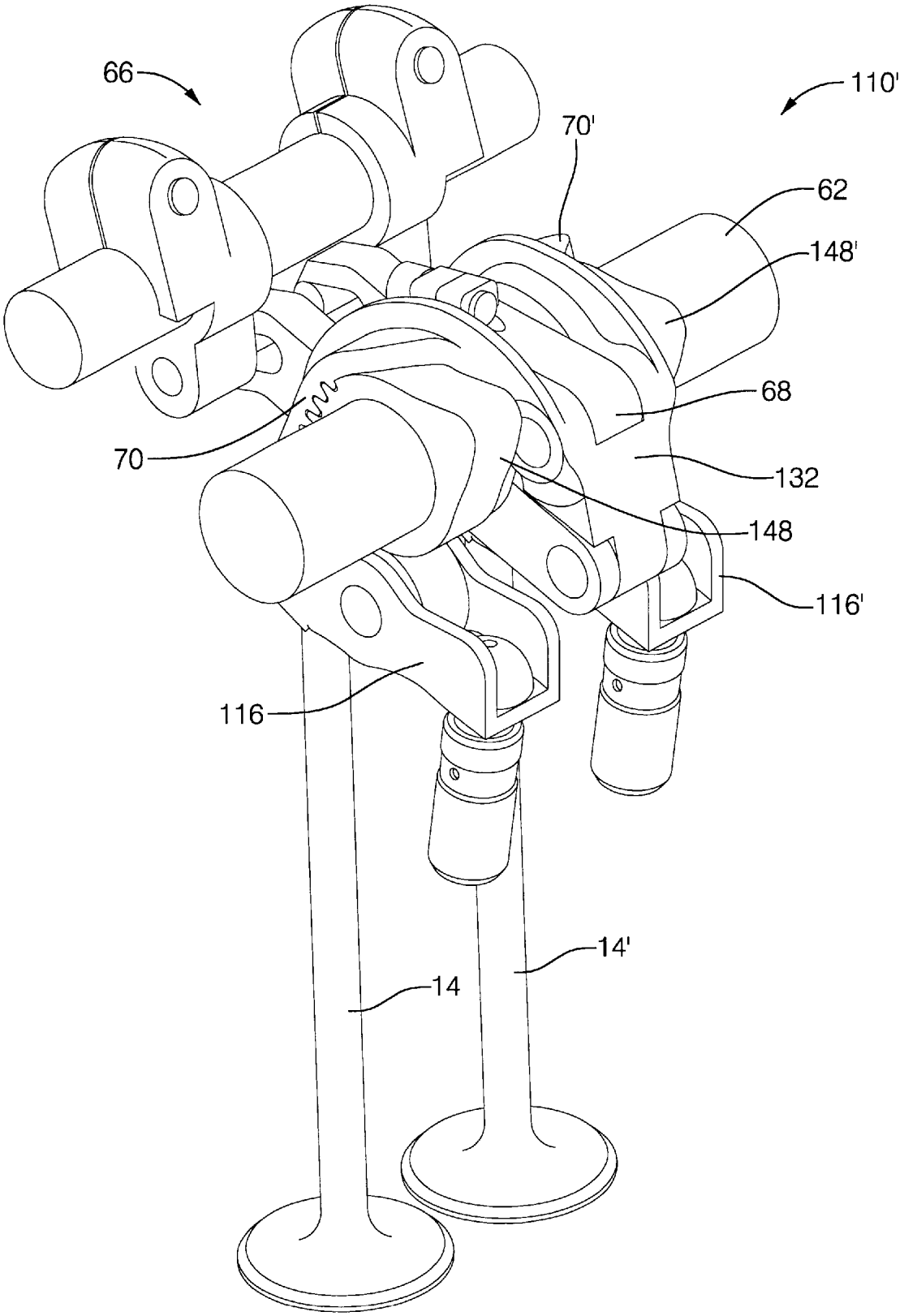
FIG. 8 is an isometric front view of the an exemplary device similar to FIG. 7, the device directly actuating two parallel engine valves, in the valve-closed position, some elements being removed for clarity.
Figure 9:
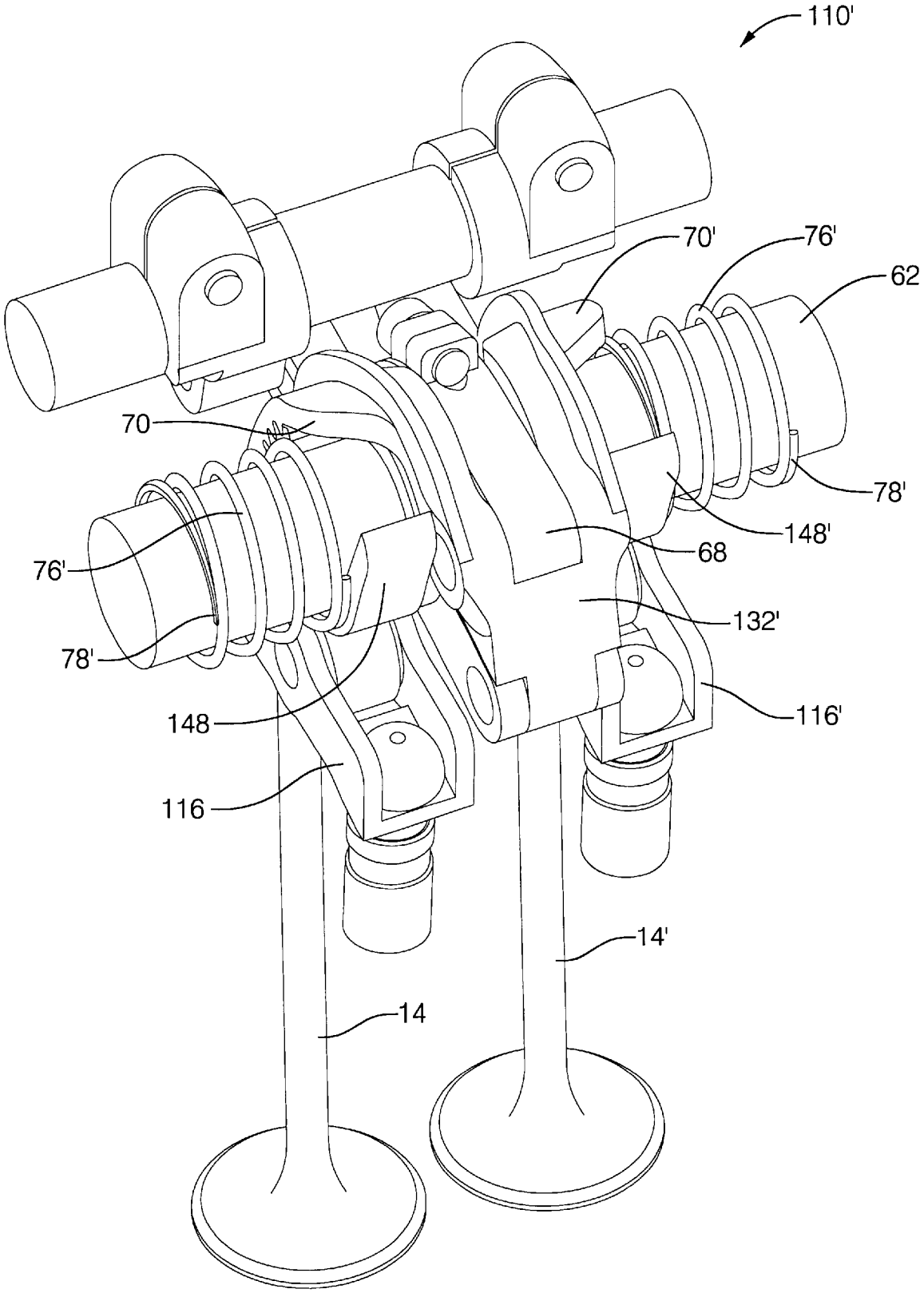
FIG. 9 is an isometric front view like that shown in FIG. 8 of an entire VVT device in accordance with the invention.

Referring to FIGS. 7, 8, and 9, a preferred embodiment 110' of the invention is adapted for actuating two valves 14,14' acting in parallel.

In FIG. 7, elements for actuating the first valve are omitted to reveal the crank journal 60 and connecting rod 68 as discussed hereinabove. Wrist pin 69 connecting rocker 132 to connecting rod 68 is extended as shown, as is pin 71 connecting rocker 132 to control frame 122, permitting substitution of a dual rocker 132' straddling connecting rod 68, as shown in FIGS. 8 and 9, and first and second ring gear portions 70,70' for driving first and second oscillatable cams 148,148' for actuating first and second roller finger followers 116,116' to open and close first and second valves 14,14'.

In a presently preferred embodiment, an axial passage in input crankshaft 62 is provided as a pressurized oil reservoir, and a network of oil passages is provided in the associated pivoting, reciprocating, and oscillating components in conventional fashion for lubricating force-loaded surfaces.

Preferably, the teeth 72 on ring gears 70,70' are axially slightly tapered away from crank journal 60 such that the valleys between the teeth are slightly more open on the side away from the crank journal. Teeth 74 on cams 148,148' are slightly tapered in the opposite direction. The tapered teeth may be formed on constant pitch circles or on conical pitch circles of conical gears, and teeth of at least one of a pair of mating gears may be crowned to control loading and wear. Axial clearance is provided on the side of each cam abutting the journal and each cam is axially extended on each side away from the journal such that axial compression springs 76,76', which are constrained at first ends 78,78' by bearing caps (not shown) for input shaft 62, biasingly urge cams 148,148', respectively, axially until the respective teeth of the cams and ring gears are fully engaged axially and all lash between the gears is thus eliminated. Preferably, the taper angles of the teeth and/or the conical pitch circles of the conical gears are made smaller than the friction angle to avoid developing axial gear separation forces greater than the urging forces of the springs. Such a scheme for eliminating gear lash is disclosed with respect to a camshaft phaser in U.S. Pat. No. 5,680,836 issued Oct. 28, 1997 to Pierik, the relevant disclosure of which is herein incorporated by reference.

It will be apparent to one of ordinary skill in the art that the ring gear variable valve train device 110, as illustrated and described herein, and many of its features, could take various forms as applied to other applications and the like. If desired, a device in accordance with the invention could also be applied to the actuation of engine exhaust valves or other appropriate applications and the like.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A variable valve train device for cooperating with an input crankshaft, an eccentric journal of the crankshaft, and the associated cylinder valve to vary the lift of the valve, comprising:

a) a frame rotatably disposed about said crankshaft;

b) a rocker arm pivotably mounted on said frame;

c) a connecting rod rotatably disposed on said eccentric journal and pivotably attached to said rocker arm for imparting rocking motion thereto;

d) a ring gear portion attached to said rocker arm for reciprocating motion thereof and having inwardly-extending teeth;

e) an output cam rotatably disposed about said crankshaft radially inward from said ring gear portion and having outwardly-extending teeth for meshing with said teeth on said ring gear portion to oscillate said cam against cylinder valve opening means to open and close said valve; and f) control means attached to said frame for controlling the angular orientation of said frame and components mounted thereupon with respect to said crankshaft for controllably varying the lift of said valve as desired.

2. A device in accordance with claim 1 further comprising means for eliminating gear lash between said ring gear portion and said output cam.

3. A device in accordance with claim 2 wherein said lash eliminating means comprises:

a) tapering of said teeth on said ring gear portion in a first axial direction;

b) tapering of said teeth on said output cam in a second and opposite axial direction; and c) means for urging said output cam axially of said ring gear portion to axially engage said tapered output cam teeth with said tapered ring gear portion teeth.

4. A device in accordance with claim 3 wherein said means for urging is a coil spring disposed on said input crankshaft.

5. A device in accordance with claim 1 wherein said output cam is a partial cam which may be installed onto said input crankshaft in a radial direction.

6. A device in accordance with claim 1 wherein said valve is a first valve for said cylinder and wherein said engine has first and second valves operating substantially in parallel for said cylinder, further comprising:

a) a second rocker connected to said first rocker to form a dual rocker having first and second ring gear portions; and b) a second output cam rotatably disposed on said crankshaft and having outwardly-extending teeth for meshing with said teeth on said second reciprocating ring gear portion to oscillate said second output cam against second cylinder valve opening means to open and close said second valve.

7. A device in accordance with claim 1 wherein said cylinder valve opening means is a roller finger follower disposed between said output cam and said valve for translating oscillatory motion of said output cam into axial motion of said valve.

8. A.device in accordance with claim 5 wherein said partial cam having an arcuate bearing surface for cooperating with said crankshaft to bear radial loads therebetween, said bearing surface extending only over a central angle sufficient to contain all operating radial forces between said partial cam and said crankshaft.

9. A device in accordance with claim 8 wherein said central angle is about 180°.

10. An internal combustion engine having a plurality of independent cylinders, and a plurality of intake valves opening upon said cylinders, said intake valves being operated by a plurality of eccentric journals disposed upon at least one input crankshaft, wherein each of said cylinders is provided with a variable valve train device for cooperating with the crankshaft, the input eccentric journals of the crankshaft, and the associated cylinder valves to vary the lift of the valves, each of said devices comprising:

a) a frame rotatably disposed about said crankshaft;

b) a rocker arm pivotably mounted on said frame;

c) a connecting rod disposed on said eccentric journal and pivotably attached to said rocker arm for imparting rocking motion thereto;

d) a ring gear portion attached to said rocker arm for reciprocating motion thereof and having inwardly-extending teeth;

e) an output cam rotatably disposed about said crankshaft radially inward from said ring gear portion and having outwardly-extending teeth for meshing with said teeth on said ring gear portion to oscillate said cam against cylinder valve opening means to open and close said valve; and f) control means attached to said frame for controlling the angular orientation of said frame and components mounted thereupon with respect to said crankshaft for controllably varying the lift of said valve as desired.

11. A method for variably controlling the lift, duration of opening, and operational timing of a valve with respect to the motion of a piston in an internal combustion engine to control the rotational speed and load of the engine, comprising the steps of:

a) providing a variable valve train device for cooperating with an input crankshaft, an input eccentric journal of said crankshaft, and said valve, including i) a frame rotatably disposed about said crankshaft, ii) a rocker arm pivotably mounted on said frame, iii) a connecting rod disposed on said eccentric journal and pivotably attached to said rocker arm for imparting rocking motion thereto, iv) a ring gear portion attached to said rocker arm for reciprocating motion thereof and having inwardly-extending teeth, v) an output cam rotatably disposed about said crankshaft radially inward of said ring gear portion and having outwardly-extending teeth for meshing with said teeth on said reciprocating ring gear portion to oscillate said cam against cylinder valve opening means to open and close said valve, and vi) control means attached to said frame for controlling the angular orientation of said frame and components mounted thereupon with respect to said crankshaft for controllably varying the lift of said valve as desired; and b) varying said control means to change said angular orientation of said frame and components as desired to increase or decrease the lift of said valve and to advance or retard the timing of opening and closing of said valve and to increase or decrease the duration of opening of said valve, thereby controlling the rotational speed and load of the engine.

* * * * *